United States Patent [19]

Ituzi et al.

[11] Patent Number: 4,909,223

[45] Date of Patent: Mar. 20, 1990

[54] AIR-FUEL RATIO CONTROL APPARATUS FOR MULTICYLINDER ENGINE

[75] Inventors: Takauki Ituzi; Sadayasu Ueno, both of Katsuta; Norio Ichikawa, Mito, all of Japan

[73] Assignees: Hitachi, Ltd., Tokyo; Hitachi Automotive Engineering Co., Ltd., Katsuda, both of Japan

[21] Appl. No.: 240,626

[22] Filed: Sep. 6, 1988

[30] Foreign Application Priority Data

Sep. 9, 1987 [JP] Japan ..... 62-223893

[51] Int. Cl.[4] ..... F02D 41/14; F02D 41/04; F02D 17/02

[52] U.S. Cl. ..... 123/481; 123/198 F

[58] Field of Search ..... 123/198 F, 325, 440, 123/481, 489, 493; 60/285, 288, 276

[56] References Cited

U.S. PATENT DOCUMENTS

| | | | |
|---|---|---|---|
| 4,107,921 | 8/1978 | Iizuka | 123/198 F X |
| 4,186,715 | 2/1980 | Iizuka et al. | 123/198 F |
| 4,201,180 | 5/1980 | Iizuka | 123/481 X |
| 4,256,074 | 3/1981 | Sugasawa et al. | 123/198 F X |
| 4,594,984 | 6/1986 | Raff et al. | 123/440 |
| 4,676,213 | 6/1987 | Itsuji et al. | 123/440 |

FOREIGN PATENT DOCUMENTS

| | | | |
|---|---|---|---|
| 0057050 | 4/1983 | Japan . | |
| 0143108 | 8/1983 | Japan . | |
| 0144644 | 8/1983 | Japan | 123/481 |
| 0000543 | 1/1984 | Japan | 123/481 |

*Primary Examiner*—Willis R. Wolfe

*Attorney, Agent, or Firm*—Antonelli, Terry & Wands

[57] ABSTRACT

In an apparatus of the type in which the air-fuel ratio of an engine is detected by an air-fuel ratio sensor and the air-fuel ratio is feedback-controlled in accordance with the detection result to operate the engine at a desired air-fuel ratio, a change of the output characteristic of the air-fuel ratio sensor is always corrected for. The apparatus includes means for detecting the air-fuel ratio of the engine from its exhaust gas composition, means for determining whether the engine is in a given constant operating condition, means for determining a desired air-fuel ratio for the constant operating condition, means for supplying the quantity of fuel corresponding to the desired air-fuel ratio to each cylinder of the engine, means for causing some of all the cylinders of the engine not greater in number than N-1 (N represents the total number of cylinders) to misfire when the engine comes into the constant operating condition, and means for correcting the output characteristic of the air-fuel ratio detecting means in accordance with the amount of change of the output of the air-fuel ratio detecting means before and after the misfiring.

15 Claims, 4 Drawing Sheets

AIR-FUEL RATIO CONTROL APPARATUS FOR MULTICYLINDER ENGINE

BACKGROUND OF THE INVENTION

The present invention relates to an air-fuel ratio control apparatus for a multicylinder engine which is designed to feedback control the quantity of fuel supplied in accordance with the detection result of the air-fuel ratio of the engine by an air-fuel ratio sensor and more particularly to a control apparatus which automatically corrects for variation with time of the output characteristic of the air-fuel ratio sensor.

Recently, the air-fuel ratio control of the so-called lean-burn type which makes the air-fuel ratio of an engine as lean as possible has been applied to the engine control of automobiles to simultaneously satisfy the demands for emission control and fuel economy. This method employs an air-fuel ratio sensor capable of substantially linearly detecting the air-fuel ratio over a wide range from the lean to the rich mixture in accordance with both the residual oxygen concentration and unburned gas concentration (hydrocarbons) in the engine exhaust gas.

Then, such air-fuel ratio sensor is used while being exposed into the exhaust gas of a considerably high temperature for a long period of time and therefore its output characteristic changes due to the physical and chemical stresses are not negligible. Thus, if the sensor is used under such condition over a long period of time, errors are increased in the detection results of the air-fuel ratio values and it is difficult to effect the air-fuel ratio control accurately.

Thus, the air-fuel ratio sensor must be used while making corrections for variations of its output characteristic as occasions demand. For example, JP-A-58-57050, filed on Sept. 29, 1981 and laid open on Apr. 5, 1983 in Japan, discloses that during the operation of an engine, all the cylinders are subjected to fuel cut-off so that the exhaust gas become the same in composition with the atmospheric air and the output of the air-fuel ratio sensor is corrected for (calibrated) in a real-time manner. Also, U.S. Pat. No. 4,676,213 of the same inventors (some of them) as the present application, registered on June 30, 1987, discloses an air-fuel ratio control apparatus capable of correcting for variation of the output from an air-fuel ratio sensor.

However, to subject all the cylinders of the engine to fuel cut-off is disadvantageous is that there is the danger of causing the engine to stall in the case of an automobile equipped with an automatic transmission.

SUMMARY OF THE INVENTION

It is an object of the present invention to provide an air-fuel ratio control apparatus which involves no danger of engine stalling, is applicable to the engines of all sorts of automobiles including automobiles with automatic transmission, is capable of always making accurate corrections despite the progress of variation in the characteristic of an air-fuel ratio sensor and is capable of maintaining the accurate air-fuel ratio feedback control.

The above object is accomplished by maintaining only part of all the cylinders of an engine in a misfiring condition during the engine operation and detecting the current output variation of an air-fuel ratio sensor thereby effecting the desired correction.

Even if the air-fuel ratio sensor is corrected for by causing a part of the cylinders to misfire, at least one of the cylinders is producing a torque. Thus, there is no danger of the engine stalling. On the other hand, due to some of the plurality of cylinders being caused to misfire, the resulting amount of change of the air-fuel ratio in the exhaust gases can be estimated accurately. Using the estimated amount of change as a reference value, it is possible to determine the ratio between the reference value and the actually detected amount of change and thereby to determine a satisfactorily accurate correction value.

DESCRIPTION OF THE PREFERRED EMBODIMENTS

The air-fuel ratio control apparatus according to the invention will now be described in greater detail with reference to the illustrated embodiment.

Figure 1:
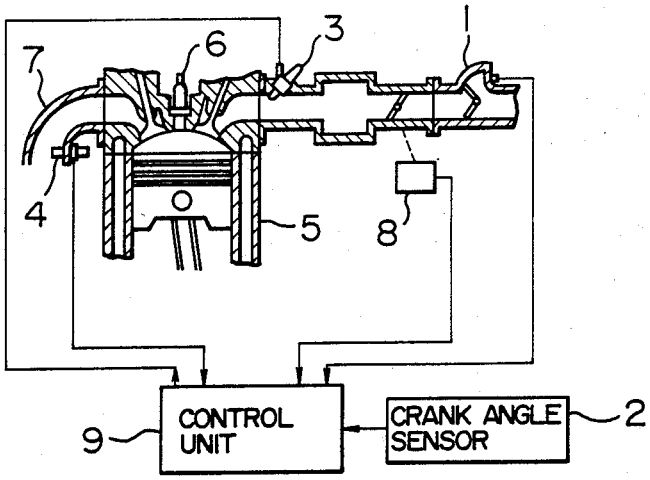
FIG. 1 is a schematic diagram showing the overall construction of an air-fuel ratio control apparatus according to the present invention.

FIG. 1 shows an example of an engine system incorporating the embodiment of the invention. The Figure shows the system with respect to one cylinder of a gasoline engine equipped with a plurality of cylinders. In the Figure, numeral 1 designates an intake air flow meter, 2 a crank angle sensor for detecting the engine speed and the position of the piston in each cylinder, 3 a fuel injection valve for separately supplying the fuel to each cylinder, 4 an air-fuel ratio sensor for detecting the air-fuel ratio of the mixture from the exhaust gas composition, 5 a cylinder, 6 a spark plug, 7 an exhaust manifold, 8 a throttle switch, and 9 a control unit.

Figure 2:
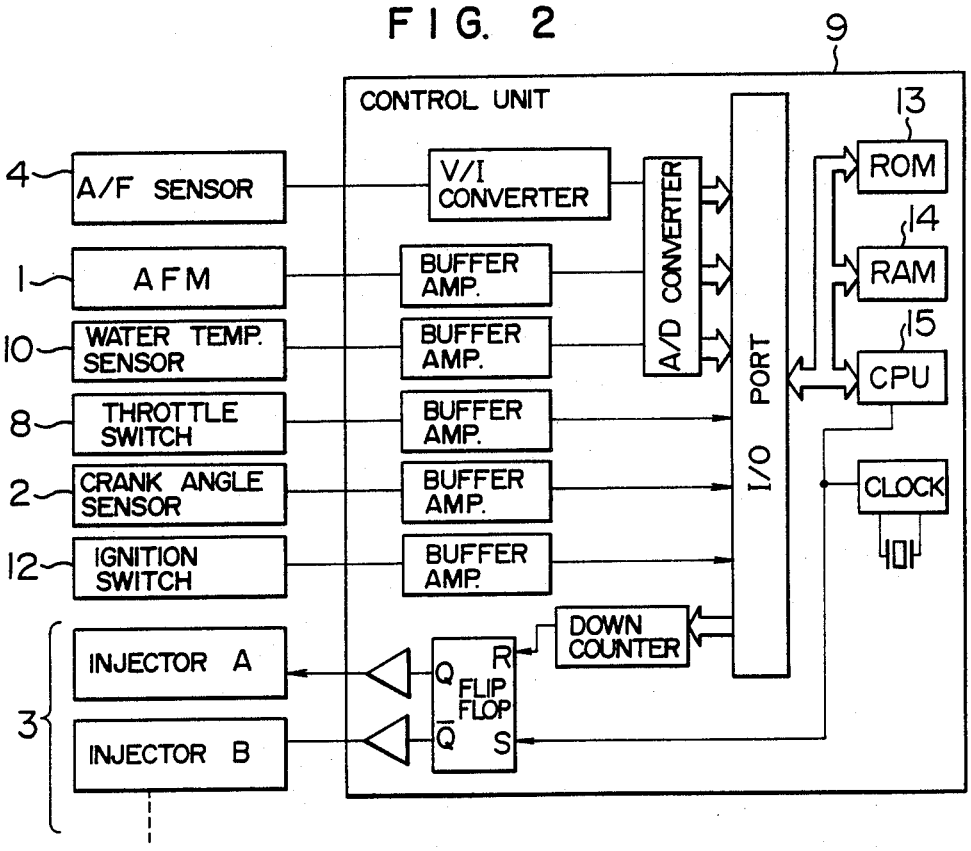
FIG. 2 is a block diagram of the control unit in FIG. 1.

FIG. 2 is a detailed block diagram of the control unit 9 whose principal part comprises a microcomputer including an ROM 13, an RAM 14 and a CPU 15.

The ROM 13 stores a program for the air-fuel ratio control and a control program for the air-fuel ratio sensor output correction which will be explained later with reference to FIG. 5. These programs are controlled by the CPU 15. In addition, the ROM 13 stores a reference value (initial value) for a change of the output of the air-fuel ratio sensor before and after the misfiring of the engine. The RAM 14 stores the value of a correction factor for the air-fuel ratio sensor. The value in the RAM 14 is updated in accordance with a variation. A CLOCK applies reference clock signals to the CPU 15 and the logical circuit in the control unit 9. An I/O port converts the signals from other circuits to signal formats that can be processed by the microcomputer or conversely converts signals to the signal formats of the other circuits. An A/D converter is a circuit for converting analog signals to digital signals. The control unit 9 is electrically connected to various sensors, switches and actuators mounted at various parts of the engine. The output of the air-fuel ratio sensor 4 is converted to a voltage signal by a current/voltage conversion circuit and the signal is further converted to a digital signal by the A/D converter for application to the CPU 15 through the I/0 port. The outputs from the air flow meter 1, a water temperature sensor 10 and the air-fuel ratio sensor 4 are analog signals and therefore these outputs are each converted to a digital signal through a buffer amplifier. The outputs from the air-fuel ratio sensor 4, the air flow meter 1, the water temperature sensor 10, the throttle switch 8, the crank angle sensor 2 and an ignition switch 12 are all applied to the CPU 15 so that a fuel injection quantity (injection time) corresponding to the desired air-fuel ratio is determined in accordance with the air-fuel ratio control program in the ROM 13 on the basis of the data stored in the same ROM 13. The determined fuel injection quantity is applied as an injection signal to a down counter through the I/O port. The injection signal is distributed at a given timing to the fuel injection valve of each cylinder by the down counter and a flip-flop. A driver amplifier amplifies the injection pulse to a magnitude sufficient to energize the injection valve. Any known control method is applicable to the above-described air-fuel ratio control.

A method of controlling the air-fuel ratio at a desired value is disclosed in JP-A-58-143108 filed by Toyota Jidosha Kogyo Kabushiki Kaisha on Feb. 19, 1982 and laid open to the public on Aug. 25, 1983.

While, in the embodiment of FIG. 1, the variable vane-type intake air flow meter 1 is used for measuring the rate of intake air flow, the rate of intake air flow may be calculated from the intake negative pressure or the throttle opening. Also, an intake air flow meter of other type, such as, the hot wire type or the Karman's vortex type may be used with the invention. Similarly, the speed of the engine may be detected by other detection method than the crank angle sensor 2, such as, the method of detecting the number of ignition pulses.

In this way, the fuel injected from the fuel injection valve 3 is mixed with air and the mixture is drawn into the cylinder 5 where it is ignited by the spark plug 6 and burned. After the combustion the exhaust gas is discharged to the exhaust manifold 7 to fully surround the air-fuel ratio sensor 4.

Figure 3:
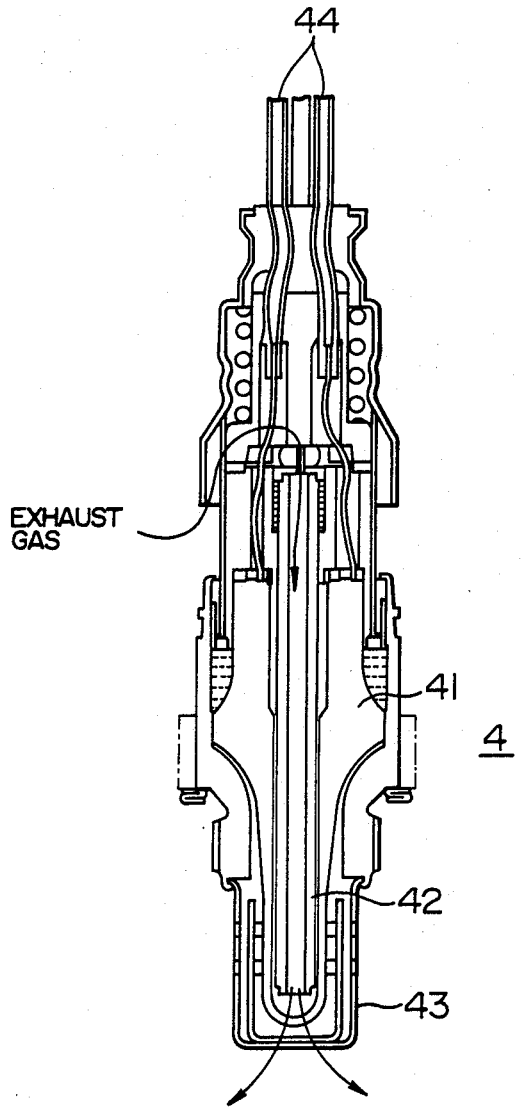
FIG. 3 is a sectional view showing an example of the air-fuel ratio sensor used with the invention.

The details of the air-fuel ratio sensor 4 are shown in FIG. 3. A voltage is applied to the electrodes 44 of the air-fuel ratio sensor 4 from the driver circuit which is not shown. The residual oxygen concentration in the exhaust gas or the value of the oxygen quantity required for oxidizing the unburned gas is detected as an oxygen pumping current. This sensor is a so-called threshold current-type sensor capable of detecting a wide air-fuel ratio range from lean to rich mixtures. Its principal parts includes a zirconia solid electrolyte 41, a built-in heater 42 and a protective tube 43.

In the control unit 9, the ROM 13 stores data indicating the relation between the values of output signals from the air-fuel ratio sensor 4 and the values of air-fuel ratios. The CPU 15 receives the output signal of the air-fuel ratio sensor 4 to search the data in the ROM 13 in accordance with the signal to determine the actual air-fuel ratio. The injection pulse signal to be supplied to the fuel injection valves 3 is corrected in a direction which causes the actual air-fuel ratio to coincide with the current desired air-fuel ratio, thus performing the air-fuel ratio feedback control. It is to be noted that the current desired air-fuel ratio is corrected not only on the basis of the output from the air-fuel ratio sensor 4 but also the data according to the engine operating condition indicative signals from the various sensors including for example the throttle switch 8, the water temperature sensor 10, etc., and these data are also provided by searching the data stored in the ROM 13. Any known method may be applied to this desired air-fuel ratio setting method.

Then, as mentioned previously, the air-fuel ratio sensor 4 is subject to variations with time of its characteristics due to physical or chemical stress during its use. Thus, as for example shown in FIG. 4, its initial output characteristic $A_1$ changes to an output characteristic $A_2$ with time.

When this occurs, the air-fuel ratio initially given by an output value $I_c$ of the air-fuel ratio sensor 4 in terms of an air excess ratio $\lambda_1$ now changes to $\lambda_2$.

Thus, if this remains unchanged, the air-fuel ratio cannot be feedback-controlled to the correct ratio.

As a result, in accordance with this embodiment, in order to prevent the engine from stopping but allow it to continuously operate stably, excluding at least one of the cylinder, the supply of the injection signal to the fuel injection valve(s) 3 of selected one(s) of the other cylinders is stopped. In this way, when the engine is stably controlled at a given air-fuel ratio, the fuel supply to given selected one(s) of the cylinders is cut off to detect any variation in the characteristic of the air-fuel ratio sensor 4 in accordance with the change of the output of the air-fuel ratio sensor 4 before and after the fuel cut-of.

In other words, only the air is introduced into the cylinder(s) to which the fuel supply has been cut off and the exhaust gas is just discharged to the exhaust manifold where they are mixed with the exhaust gas from the other cylinders. Therefore, the air-fuel ratio is increased adjusted leaner) by an amount corresponding to the cylinder(s) to which the fuel supply has been cut off.

If this case, if the respective cylinders have the same piston displacement, the increase in the air-fuel ratio is equal to the product of the difference between the oxygen concentration of the air and the oxygen concentration in the exhaust gas from the firing cylinders and the ratio between the number of the fuel cut-off cylinders and the number of the cylinders supplied with fuel. Then, since the oxygen concentration of the air is substantially constant, the increase in the oxygen concentration is substantially constant. Also, the oxygen pump current of the air-fuel sensor varies linearly with the oxygen concentration. Thus, in accordance with the amount of increase in the oxygen pump current value corresponding to a given variation of the air-fuel ratio, it is possible to detect a change of the characteristic of the air-fuel ratio sensor and the necessary calibration can be effected.

Referring again to FIG. 2, in response to the signal from the throttle switch 8, etc., the CPU 15 detects that the air-fuel ratio is maintained constant such as when the engine is idling, decelerating or operating at a constant speed and on this condition it is controlled to stop the supply of an injection signal to one of the fuel injection valves 3, e.g., the fuel injection valve A for a given period of time.

As regards the method of detecting that the engine is in a constant operating condition, that is, it is maintained at a constant air-fuel ratio, this can be accomplished by considering that the engine is in a constant operating condition when any one of the following conditions (I) to (III) is met.

(I) Idling
Water temperature: 70°-75° C.
Throttle opening: 0°
Engine speed: 750±220 rpm
Intake air flow: 20±0.4 Kg/h
(II) Constant speed
Water temperature: 75°-80° C.
Throttle opening: 35°0.5°
Engine speed: 2,000±50 rpm
Intake air flow: 150±3 Kg/h
(III) Deceleration
Water temperature: 75°-80° C.
Throttle opening: 0°
Engine speed: 1,000-3,000 rpm
Transmission: Other than neutral The above condition are applicable to a class of engines having a displacement of 1.8 liters, and the present invention is not intended to be limited to the above-mentioned numerical values and kinds of conditions. It is only necessary to select suitable constant operating conditions in accordance with the displacement and type of an engine.

The detection of the above-mentioned conditions is effected in such a manner that the CPU 15 receives the outputs of the water temperature sensor 10, the throttle switch 8, the crank angle sensor 2 and the air flow meter 1 shown in FIG. 2 and a transmission switch (for detecting the neutral position) which is not shown to determine the constant operating condition of the engine in accordance with the condition decision program stored in the ROM 13.

Assuming now that the above-mentioned constant operating conditions are met in the case of an engine having Tn cylinders (Tn is an integer not less than 2), if the n cylinder(s) (n is an integer greater than 1) are caused to misfire, the resulting change ΔP of the oxygen concentration in the exhaust manifold 7 (the oxygen concentration will be increased in the case of the misfiring due to the cutting off of the fuel supply) is represented by the following equation (1)

$$\Delta P = \left\{ \frac{n}{Tn} \cdot P + \frac{Tn - n}{Tn} \cdot P_o \right\} - Po \quad (1)$$

Where
ΔP=the amount of increase in the oxygen concentration
P=the oxygen concentration in the air (21%)
Tn=the total number of cylinders
n=the number of misfired cylinders
$P_o$=the oxygen concentration in the exhaust gas when all the cylinders are firing Simplifying the above equation (1) results $$\Delta P = \frac{n}{Tn} (P - P_o) \quad (2)$$

Here, the oxygen concentration P in the air is constant and also the residual oxygen concentration $P_o$ of the exhaust gas during the combustion in a given constant operating condition is constant. Therefore, if an engine operating condition requiring misfiring and a number of the cylinders to be misfired are preset to be constant, the change ΔP of the oxygen concentration in the exhaust gas or the change of the air-fuel ratio before and after the misfiring, given by equation (2), becomes constant. If the output characteristic of the air-fuel ratio sensor, shown in FIG. 4, retains its initial condition $A_1$, the sensor output change dK corresponding to the air-fuel ratio change ΔP due to the misfiring remains unchanged. However, if the sensor output characteristic changes from $A_1$ to $A_2$, the sensor output change corresponding to the air-fuel ratio change ΔP becomes dK'. The ratio between dK and dK' is the required correction factor for the air-fuel ratio sensor.

Figure 4:
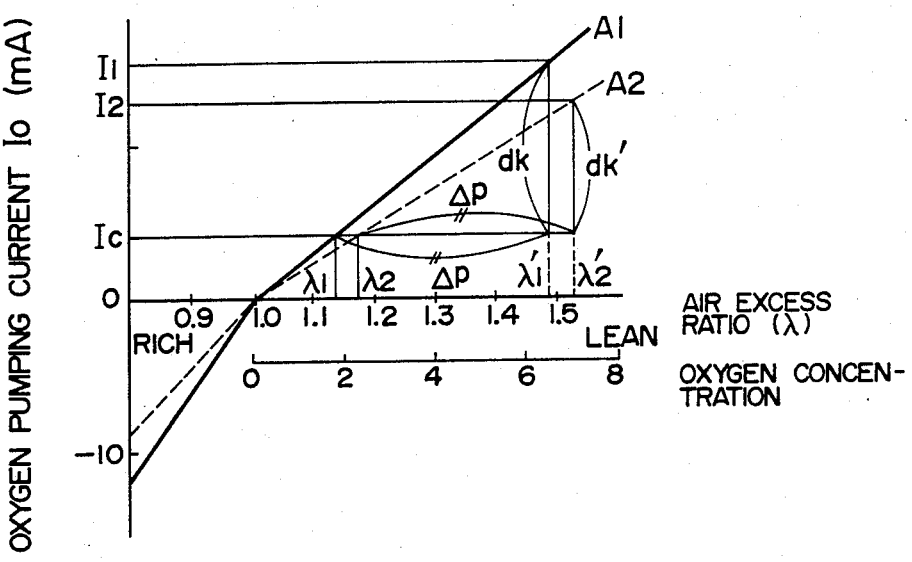
FIG. 4 is an output characteristic diagram of the air-fuel ratio sensor.

In other words, assuming that the output characteristic of the air-fuel ratio sensor 4 is the one represented by $A_1$ in FIG. 4, $\lambda_1$ represents the air excess ratio when the output current (oxygen pump current) is $I_c$ so that if the air-fuel ratio changes by ΔP, the air excess ratio becomes $\lambda_1'$ and the output current corresponding to $\lambda_1'$ becomes $I_1$. Thus, if the output characteristic retains its initial condition $A_1$, the change dK ($=I_1-I_c$) of the output current should be maintained constant.

Assume now that the output characteristic of the air-fuel ratio sensor 4 has changed from $A_1$ to $A_2$.

When this occurs, the air excess ratio corresponding to the output current $I_c$ becomes $\lambda_2$ so that if the air-fuel ratio changes by ΔP, the air excess ratio becomes $\lambda_2$ and the corresponding output current becomes $I_2$. Therefore, if the change of the output current $dK=I_1-I_c$ is given as a change reference value in terms of a constant α, then the following holds $$K=\alpha/(I_2-I_c) \quad (4)$$

The value of α is preliminarily determined experimentally and stored in the ROM 13 of the control unit 9. Then, each time the engine comes into the previously mentioned constant operating condition, the given cylinder or cylinders are misfired so that the current output change $dK'=I_2-I_c$ of the air-fuel ratio sensor is detected and a correction factor K is calculated along with the value of α in the ROM 13. Further, this correction factor K is successively stored in the RAM 14 in the form of one obtained by updating the previous factor K. The correction factor K stored in the RAM 14 is used for correcting the output of the air-fuel ratio sensor 4 during the air-fuel ratio feedback control, thereby always controlling it at the accurate desired air-fuel ratio.

Figure 5:
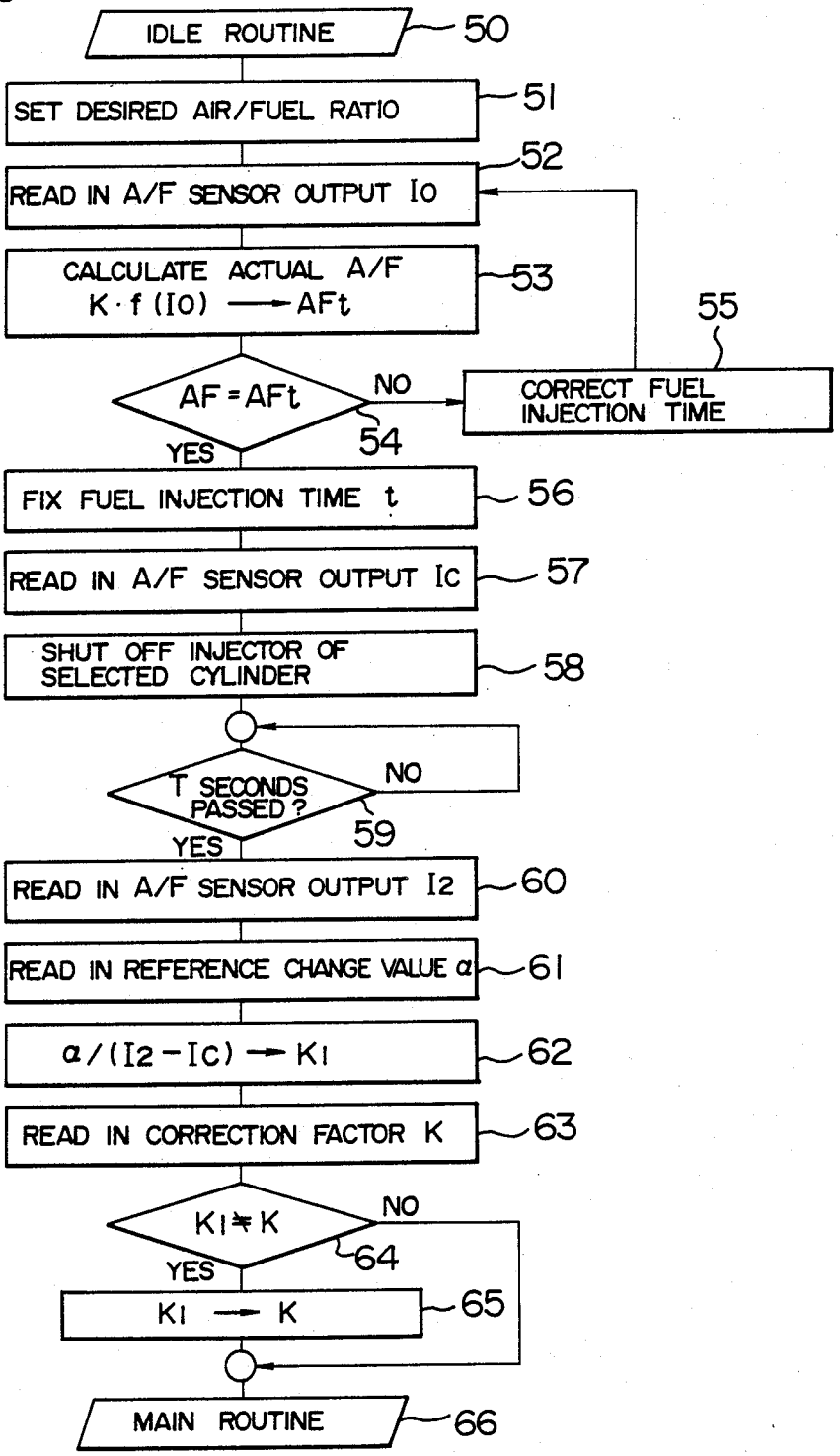
FIG. 5 is a flow chart showing the operation of correcting the output characteristic of the air-fuel ratio sensor according to the invention.

The operational processing shown in FIG. 5 is executed by the CPU 15 when the CPU 15 determines that the operating condition of the engine is an idling operation during the ordinary air-fuel ratio feedback control.

Such constant operating conditions of the engine may include a constant speed condition and deceleration condition where the air-fuel ratio of the engine is stable. In the case of engine which is low in output torque and small in the number of cylinders, however, causing one of the cylinders to misfire during the constant speed running is not much preferred in view of a considerable change imparted to the driver. On the other hand, during the deceleration condition the driving performance is not much affected by the occurrence of such misfiring and therefore the determination of a correction factor may be effected when the engine comes into the deceleration condition.

Referring again to FIG. 5, steps 51 to 55 are operations for determining a fuel injection time t for maintaining constant the air-fuel ratio during the idling operation at a desired air-fuel ratio.

At the step 51, the CPU 15 determines the desired air-fuel ratio for the idling operation. At the step 52, the output of the air-fuel ratio sensor 4 is read in. At the step 53, the actual air-fuel ratio is determined by multiplying the output of the air-fuel ratio sensor 4 by the correction factor K stored in the RAM 14. At the step 54, it is determined whether the desired air-fuel ratio coincides with the actual air-fuel ratio. If it is not, the fuel injection time (corresponding to the injection quantity) is adjusted in a direction which reduces the air-fuel ratio error to zero. After the step 55, a return is made to the step 52. If it is determined at the step 54 that there is no air-fuel ratio error, it means that the air-fuel ratio is controlled at the desired air-fuel ratio and therefore the set fuel injection time is fixed at a step 56. At a step 57, the air-fuel ratio sensor output $I_c$ is read in. At a step 58, the fuel injection valve of preselected one of the cylinders is rendered inoperative causing the cylinder to misfire. This is accomplished by stopping the supply of a drive signal to the fuel injection valve. At a step 59, the misfiring condition is maintained for a given period of time. This given time is an interval of time between the instance of misfiring and the instance that the oxygen concentration in the exhaust gas is stabilized and it is preferably from 2 seconds to about 3 seconds. This time is preliminarily determined by experiments.

Then, when a point is reached so that a stable oxygen concentration is attained, the output $I_2$ of the air-fuel sensor 4 is read in at a step 60.

At a step 61, the change value $\alpha$ serving as a reference is read from the ROM 13 in the control unit 9. At a step 62, a correction factor $K_1=\alpha/(I_2-I_c)$ is calculated.

At a step 63, the correction factor K stored in the RAM 14 is read in. At a step 64, the correction factors $K_1$ and K are compared. If the two values are equal, the control is just returned to a main routine 66. If the two valves are not equal, a transfer is made to a step 65 where the value of K is rewritten to $K_1$ and stored in the RAM 14, thereby making a return to the main routine 66. This main routine is the air-fuel ratio control routine of the engine which is executed ordinarily.

Figure 6:
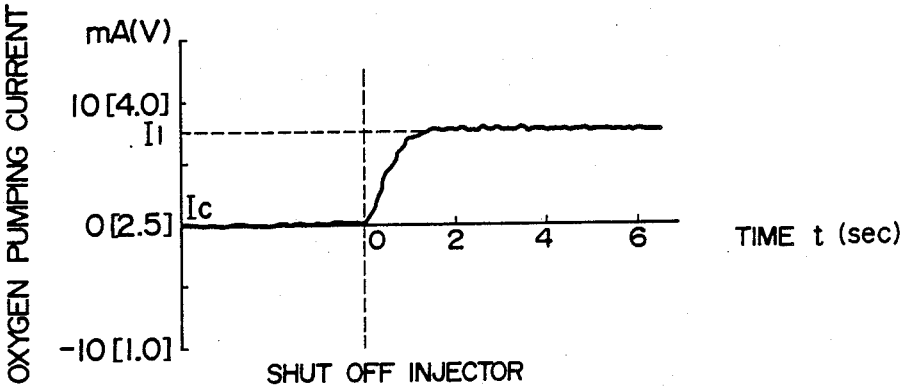
FIG. 6 is an output response characteristic diagram of the air-fuel ratio sensor.

FIG. 6 shows the actually obtained results of the changes in the output of the air-fuel ratio sensor caused by the stopping of the fuel injection into the selected cylinder with the desired air-fuel ratio being set to a stoichiometric air-fuel ratio. The output was stabilized in a period of about 2 to 3 seconds after the beginning of misfiring and it attained a substantially constant value, although there was some disturbance in the air-fuel ratio.

It is to be noted that this disturbance can be satisfactorily suppressed by making and device on the construction of the exhaust manifold.

Thus, in accordance with the above-described embodiment, each time the engine in operation comes into a given operating condition such as an idling condition, constant speed condition or deceleration condition, the processing of FIG. 5 is executed and a new correction factor K is calculated each time. In accordance with the correction factor K, the change in the output characteristic of the air-fuel ratio sensor 4 is corrected for so that it is possible to always detect the accurate air-fuel ratio and thereby to maintain the accurate air-fuel ratio feedback control.

While, in the above-described embodiment, as a means of excluding at least one of the plurality of cylinders and causing at least one of the remaining cylinders to misfire, the method of cutting off the fuel supply to the air drawn into the cylinder is used, as an alternative, it is possible to interrupt the supply of a sparking voltage to the spark plug of the cylinder selected for misfiring. Namely, the fuel is ordinarily supplied to all the cylinders and a sparking voltage is not supplied to the spark plug of the cylinder selected for misfiring. Thus, at this time the oxygen concentration in the exhaust manifold should be increased by a given value as the result of the misfiring so that by detecting the increase in the air-fuel ratio and calculating the change in the output of the air-fuel ratio sensor from equation (2), it is possible to obtain a correction factor K.

Further, in addition to the above embodiment, a modification may be made to monitor the correction factor K so that when it exceeds a given value, the change in the characteristic of the air-fuel ratio sensor is considered to have exceeded a tolerance and a suitable alarm is given by for example turning on a warning lamp.

By applying the invention to automobile gasoline engines, irrespective of whether the automobiles are automatic transmission equipped ones or manual gear shifting ones, the air-fuel ratio sensor can be calibrated without causing the engine to stall. There is another effect that the air-fuel ratio sensor can be calibrated without especially providing any device for determining whether the exhaust pipe is filled with the air and the proper air-fuel ratio control can always be effected with the resulting improvement in fuel consumption.

We claim:

1. An air-fuel ratio control apparatus for a multicylinder engine comprising:

air-fuel ratio detecting means for detecting a value of an air-fuel ratio of an engine from a composition of exhaust gas from said engine to generate as an electric signal;

means for detecting a predetermined steady-state operating condition of said engine;

means for determining a desired air-fuel ratio for said steady-state operating condition;

means for supplying a fuel flow corresponding to said desired air-fuel ratio to each cylinder of said engine;

means responsive to the detection of the steady-state operating condition of said engine for causing some of all the cylinders of said engine not greater in number than N−1 cylinders (N represents the total number of cylinders) to misfire; and means responsive to an amount of change of the output value of said air-fuel ratio detecting means before and after the operation of said misfiring activation means for correcting an output characteristic of said air-fuel ratio detecting means.

2. An apparatus according to claim 1, wherein said misfiring activating means comprises means for stopping the supply of fuel to said number of cylinder not greater than said N−1.

3. An apparatus according to claim 1, wherein said misfiring activating means comprises means for stopping the ignition in said number of cylinders not greater than said N−1.

4. An apparatus according to claim 2, wherein said correcting means comprises first memory means for storing a reference value for a change of the output value of said air-fuel ratio detecting means before and after the operation of said misfiring activating means, and means for determining a difference between first and second output values of said air-fuel ratio detecting means at the times before and after the operation of said misfiring activating means and calculating a ratio between said difference value and said reference value to determine a correction value for an output characteristic of said air-fuel ratio detecting means.

5. An apparatus according to claim 4, wherein said correcting means further comprises second memory means for storing said correction value, means for comparing a correction value newly determined by said correction value determining means with said correction value stored in said second memory means, and means for replacing said stored correction value by said newly determined correction value when said comparing means determines that said correction values are not equal.

6. An apparatus according to claim 5, wherein said steady-state operating condition detecting means comprises means for detecting at least one of an idling condition, decelerating condition and constant speed condition of said engine.

7. An apparatus according to claim 6, wherein said correction value determining means comprises means for receiving said second output value of said air-fuel ratio detecting means at the expiration of at least two seconds after the operation of said misfiring activating means.

8. An apparatus according to claim 7, wherein said air-fuel ratio detecting means comprises an air-fuel ratio sensor responsive to values of a residual oxygen concentration and unburned component concentration in exhaust gas of said engine to detect an air-fuel ratio, said air-fuel ratio sensor producing an output of a substantially linear characteristic with respect to the value of said air-fuel ratio.

9. An apparatus according to claim 8, further comprising means for indicating when said difference value between said first and second outputs of said air-fuel ratio detecting means exceeds a predetermined value.

10. An apparatus according to claim 3, wherein said correcting means comprises first memory means for storing a reference value for a change of the output value of said air-fuel ratio detecting means before and after the operation of said misfiring activating means, and means for determining a difference between first and second output values of said air-fuel ratio detecting means at the times before and after the operation of said misfiring activating means and calculating a ratio between said difference value and said reference value to determine a correction value for an output characteristic of said air-fuel ratio detecting means.

11. An apparatus according to claim 10, wherein said correcting means further comprises second memory means for storing said correction value, means for comparing a correction value newly determined by said correction value determining means with said correction value stored in said second memory means, and means for replacing said stored correction value by said newly determined correction value when said comparing means determines that said correction values are not equal.

12. An apparatus according to claim 11, wherein said steady-state operating condition detecting means comprises means for detecting at least one of an idling condition, decelerating condition and constant speed condition of said engine.

13. An apparatus according to claim 12, wherein said correction value determining means comprises means for receiving said second output value of said air-fuel ratio detecting means at the expiration of at least two seconds after the operation of said misfiring activating means.

14. An apparatus according to claim 13, wherein said air-fuel ratio detecting means comprises an air-fuel ratio sensor responsive to values of a residual oxygen concentration and unburned component concentration in exhaust gas of said engine to detect an air-fuel ratio, said air-fuel ratio sensor producing an output of a substantially linear characteristic with respect to the value of said air-fuel ratio.

15. An apparatus according to claim 14, further comprising means for indicating when said difference value between said first and second outputs of said air-fuel ratio detecting means exceeds a predetermined value.

* * * * *